US006604643B1

(12) United States Patent
Michael et al.

(10) Patent No.: US 6,604,643 B1
(45) Date of Patent: Aug. 12, 2003

(54) BOTTLE SECURITY DEVICE

(75) Inventors: Robert L. Michael, Canton, OH (US); Nicholas M. Sedon, Massillon, OH (US); Christopher G. Gallagher, Akron, OH (US); Dennis D. Belden, Jr., Canton, OH (US); Michael S. Jaeb, Millersburg, OH (US)

(73) Assignee: Alpha Security Products, Inc., North Canton, OH (US)

( * ) Notice: Subject to any disclaimer, the term of this patent is extended or adjusted under 35 U.S.C. 154(b) by 0 days.

(21) Appl. No.: 09/338,819

(22) Filed: Jun. 23, 1999

Related U.S. Application Data

(60) Provisional application No. 60/090,479, filed on Jun. 24, 1998.

(51) Int. Cl.[7] ..... B65D 50/08

(52) U.S. Cl. ..... 215/204; 215/253; 215/278; 220/255.1

(58) Field of Search ..... 215/201, 204, 215/207, 215–217, 219, 221, 224, 225, 273, 275, 277, 278, 280, 286, 290, 293, 302, 251, 253; 220/210, 255, 255.1, 256.1, 284, 315

(56) References Cited

U.S. PATENT DOCUMENTS

| | | | |
|---|---|---|---|
| 445,755 | A | 2/1891 | King |
| 654,533 | A | 7/1900 | Garner |
| 770,387 | A | 9/1904 | Richards |
| 783,885 | A | 2/1905 | McDougall |
| 809,213 | A | 1/1906 | Osgood |
| 833,446 | A | 10/1906 | Degener |
| 880,723 | A | 3/1908 | Cumming |
| 1,343,962 | A | 6/1920 | Byrne |
| 1,937,295 | A | 11/1933 | Rettenmeyer |
| 2,418,039 | A | 3/1947 | Mays |
| 3,025,990 | A | 3/1962 | Pancrazi |
| 3,804,284 | A | 4/1974 | Moore et al. |
| 3,893,582 | A | 7/1975 | Kowalik |
| 3,944,102 | A | 3/1976 | Grau |
| 4,056,209 | A | 11/1977 | Winkler et al. |

(List continued on next page.)

FOREIGN PATENT DOCUMENTS

| | | |
|---|---|---|
| DE | 2121739 | 11/1972 |
| DE | 2 307 205 | 8/1974 |
| DE | 3211387 | 9/1983 |
| EP | 0385540 | 5/1990 |
| EP | 0522679 | 1/1993 |
| EP | 0687635 | 12/1995 |
| FR | 2586231 | 2/1987 |
| FR | 2608285 | 6/1988 |
| GB | 677311 | 8/1952 |
| GB | 2 082 552 | 3/1982 |

(List continued on next page.)

*Primary Examiner*—Nathan J. Newhouse
(74) *Attorney, Agent, or Firm*—Sand & Sebolt

(57) ABSTRACT

A bottle security device includes an inner member and an outer member that cooperate to lock the bottle security device on the neck of a bottle. The inner member includes a plurality of fingers that are adapted to fit under the bead on a bottle neck. The inner member further includes outwardly extending teeth. The outer sleeve member of the device slides over the inner member and forces the fingers against the bottle. The outer sleeve member further includes a plurality of upwardly extending arms that have inwardly projecting teeth that engage the teeth of the inner member to lock the two members together. A key is used to separate the two pieces and release the security device from the bottle. The key extends down through the top of the outer sleeve member to physically engage the upwardly extending arms and to move them radially outward to where they disengage the inner member.

27 Claims, 9 Drawing Sheets

U.S. PATENT DOCUMENTS

| | | | |
|---|---|---|---|
| 4,260,067 | A | 4/1981 | Audruchiw |
| 4,279,353 | A | 7/1981 | Honma |
| 4,570,810 | A | 2/1986 | Hawkins |
| 4,710,752 | A | 12/1987 | Cordery |
| 4,775,061 | A | 10/1988 | Coote |
| 5,085,332 | A | 2/1992 | Gettig et al. |
| 5,269,429 | A | 12/1993 | Schumacher |
| 5,303,835 | A | 4/1994 | Haber et al. |
| 5,386,924 | A | 2/1995 | Flinta et al. |
| 5,431,293 | A | 7/1995 | Piron |
| 5,464,109 | A | 11/1995 | Greenwald |
| 5,519,381 | A | 5/1996 | Marsh et al. |
| 5,586,670 | A | 12/1996 | Greenwald |
| 5,602,530 | A | 2/1997 | Holmgren |
| 5,749,484 | A | 5/1998 | Trout |
| 5,769,252 | A | 6/1998 | Volpe |

FOREIGN PATENT DOCUMENTS

| | | |
|---|---|---|
| WO | WO 89/07076 | 8/1989 |
| WO | WO 91/04201 | 4/1991 |
| WO | WO 92/00173 | 1/1992 |
| WO | WO 92/12067 | 7/1992 |
| WO | WO 94/08867 | 4/1994 |
| WO | WO 97/00819 | 1/1997 |

BOTTLE SECURITY DEVICE

CROSS-REFERENCE TO RELATED APPLICATION

This Application claims priority from the U.S. Provisional Patent Application Ser. No. 60/090,479 filed Jun. 24,1998, the disclosures of which are incorporated herein by reference.

BACKGROUND OF THE INVENTION

1. Technical Field

This invention relates to article security devices used by retail and similar stores and outlets. More particularly, the invention relates to electronic article surveillance security devices attachable to articles in a manner that make the devices essentially impossible to remove or disable absent destruction of the devices or using keys that release the devices from the item on which they are secured. Specifically, the present invention is related to a bottle security device that holds an electronic article surveillance component where the bottle security device is configured to be received over the end of a typical bottle such as those bottles used to hold beer, wine, and liquor, in a manner that prevents its removal absent substantial damage to the bottle or bottle security device or the use of a corresponding key.

2. Background Information

The need to prevent, deter, stop, and/or catch shoplifters has become of increased concern to retail store owners in recent times. To meet this increasing demand, various forms of electronic article surveillance have been developed. One type of electronic article surveillance includes the use of a detector that is typically disposed about the exit and entrance to the retail establishment. The system then utilizes electronic article surveillance (hereinafter EAS) tags that are attached to items in the retail store. An alarm may be activated when an EAS tag is passed in close proximity to the detector. Thus, if a shoplifter attempts to take an article having an EAS tag through the exit, an alarm sounds and the management of the store is immediately notified.

One drawback to such a system is that an EAS tag must be placed on each article in the store to protect the article from theft. Although such systems are manageable for stores that sell articles such as videocassettes, compact discs, audio cassettes, and other boxed materials where an EAS tag can be hidden in a place where it cannot be removed, such systems are impracticable for retail stores that sell items having packaging that does not provide a readily available space for hiding or securing an EAS tag. Although locking straps have been developed that wrap about a portion of an article to secure an EAS tag to the article, such EAS tag-carrying straps may be defeated when the article being protected may be easily transferred to another container. Such is the case when the article being protected is wine or liquor.

A retail store selling wine or liquor cannot easily attach an EAS tag to the liquor bottles in a location where it cannot be easily removed by a shoplifter. Further, if an EAS tag-carrying locking strap is utilized, the shoplifter may still open the bottle of liquor and pour the contents into an untagged container and then leave the store. It is thus desired in the art to provide a device that carries an EAS component that may be utilized to prevent the unauthorized opening of a typical wine or liquor bottle. For such a device to be commercially successful, the device must fit a variety of differently sized bottles while being openable with a common key held by the check-out clerk in the retail store. Such devices must also be able to withstand twisting, prying, and shock forces applied to the device by a shoplifter in order to dislodge the device from a bottle.

One example of an anti-theft device for bottles is disclosed in U.S. Pat. No. 5,602,530. The device disclosed in this patent includes an outer socket which can be moved in relation to an inner socket between two end positions with one of the end positions being a locking position. A plurality of retainers are distributed about the periphery of the inner surface of the outer socket. The retainers extend into the inner socket when the outer socket is in the locked end position. These retainers engage the bottle beneath the bead that is typically disposed on the neck of a bottle. The retainers thus prevent the removal of the device from the neck of the bottle until biased outwardly by a magnetic key. Although devices such as this function for their intended purpose, room for improvement remains in the art.

SUMMARY OF THE INVENTION

It is therefore an objective of the present invention to provide a bottle security device capable of holding an EAS tag for commonly-sized beer, wine, and liquor bottles.

Another objective of the invention is to provide a bottle security device that can be produced in large quantities relatively inexpensively with one-piece molded plastic members.

Yet another objective of the present invention is to provide a bottle security device capable of being secured to bottles of various shapes and sizes.

Still another objective of the present invention is to provide a bottle security device that is inexpensive and easy to both make and use and that can be easily and repeatedly used by retail shop personnel.

A further objective of the present invention is to provide a bottle security device that can be molded of rugged plastic that is very difficult to break, rip, or otherwise disable.

Still a further objective of the present invention is to provide a bottle security device that cooperates with the bead or other structures commonly present on the neck of a bottle to lock itself to the neck of a bottle where it cannot be removed without the use of a corresponding key or by significantly damaging the bottle security device.

Another objective of the present invention is to provide a bottle security device that locks on the neck of a bottle and prevents the contents of the bottle from being removed from the bottle without removing the bottle security device or breaking the bottle.

Another objective of the present invention is to provide a bottle security device having locking members that cannot easily be picked by a shoplifter.

Another objective of the present invention is to provide a bottle security device that includes a ring that functions to prevent a shoplifter from easily prying the device off of the neck of a bottle.

Another objective of the present invention is to provide a bottle security device which is of simple construction, which achieves the stated objectives in a simple, effective, and inexpensive manner, and which solves the problems and satisfies the needs in the art.

These and other objectives and advantages of the present invention are obtained by the improved bottle security device of the present invention, the general nature of which includes an inner member adapted to fit around at least a portion of the neck of the bottle; at least one tooth projecting outwardly from the inner member; an outer member having a cavity, the inner member selectively positionable in the cavity; at least one arm resiliently cantilevered from the outer member and disposed in the cavity; at least one tooth projecting inwardly from the arm; and the tooth on the inner member engaging the tooth on the arm when the inner member is positioned in the cavity to prevent the inner member from being removed from the cavity.

Other advantages and objectives of the invention are achieved by the improved bottle security device of the present invention, the general nature of which includes an inner member adapted to fit around at least a portion of the neck of the bottle; an outer member having a cavity, the inner member selectively lockable in the cavity; and a ring connected to the inner member; the ring adapted to surround a portion of the neck of the bottle.

BRIEF DESCRIPTION OF THE DRAWINGS

Preferred embodiments of the invention, illustrative of the best mode in which the applicants have contemplated applying the principles of the invention, are set forth in the following description and are shown in the drawings and are particularly and distinctly pointed out and set forth in the appended claims.

Similar numerals refer to similar parts throughout the specification.

DESCRIPTION OF THE PREFERRED EMBODIMENTS

Figure 1:
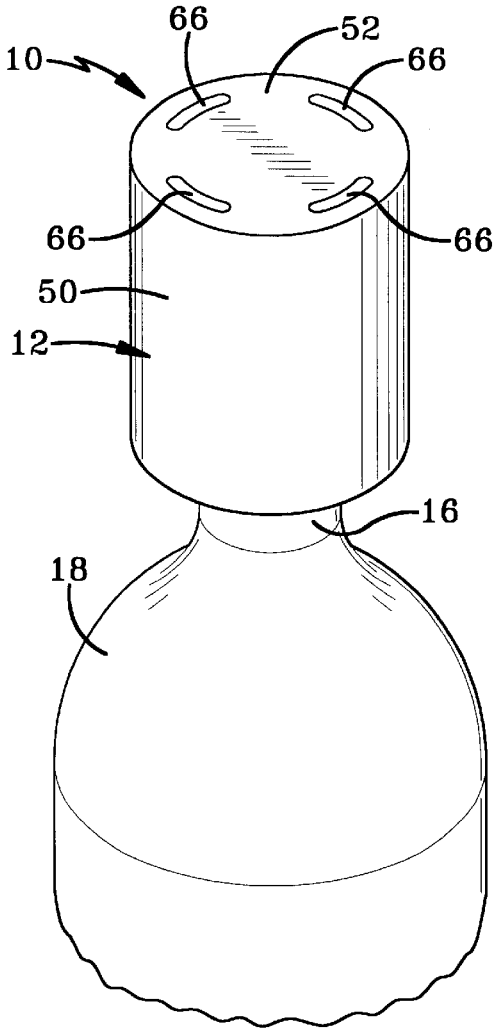
FIG. 1 is a perspective view of the bottle security device of the present invention in a locked position on a bottle.
Figure 2:
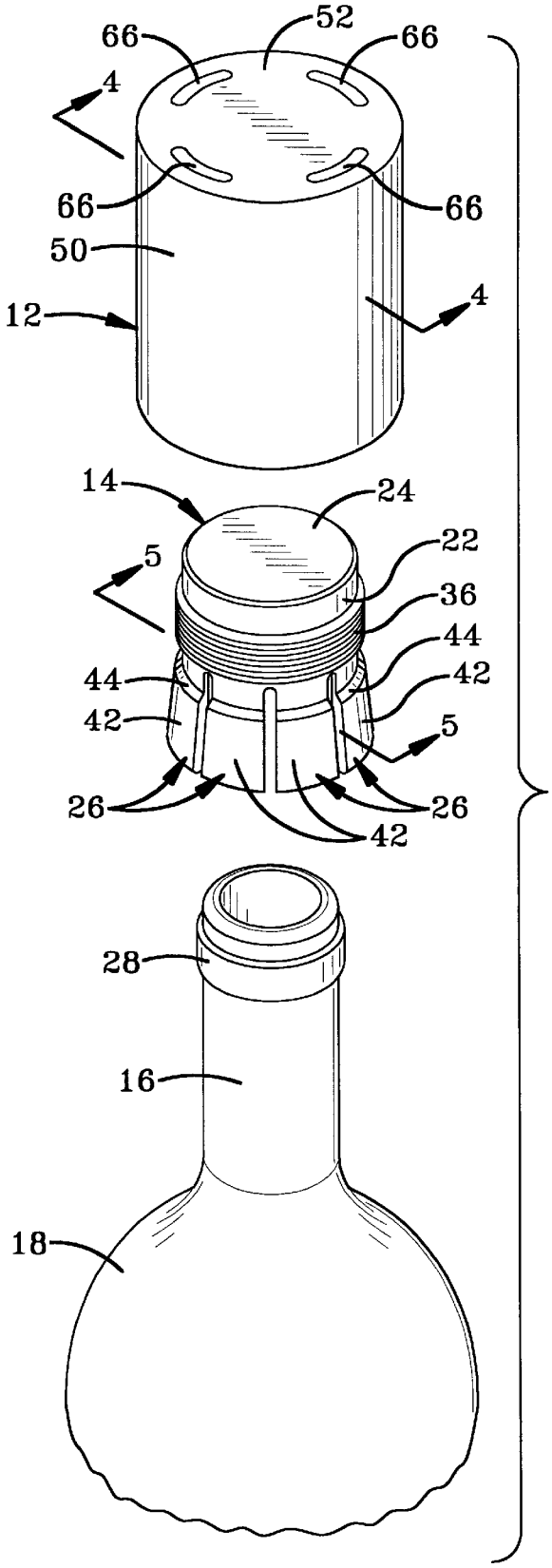
FIG. 2 is an exploded view of the security device and bottle of FIG. 1.
Figure 3:
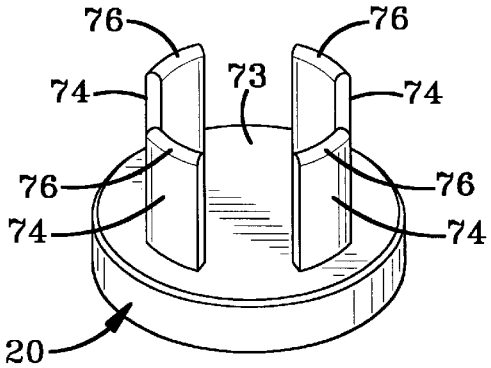
FIG. 3 is a perspective view of a key for use with the security device of FIG. 1.
Figure 4:
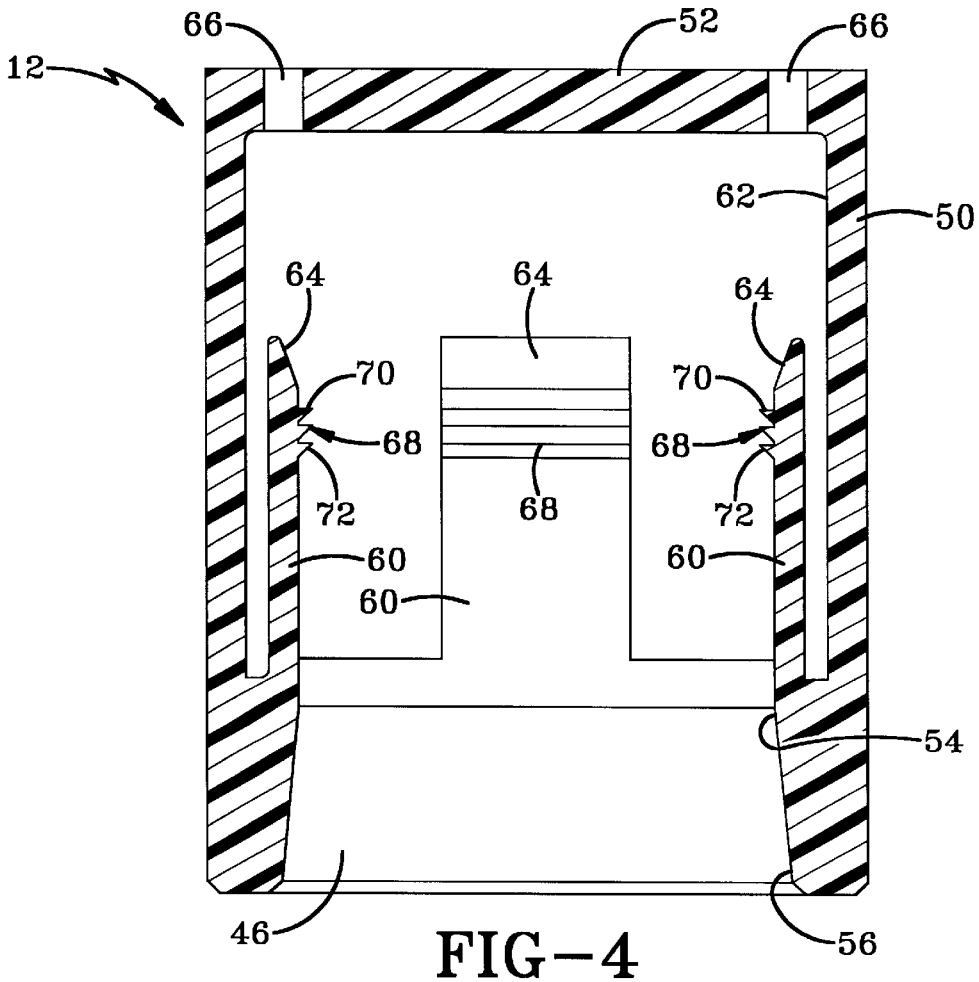
FIG. 4 is a sectional view taken along line 4—4 of FIG. 2.
Figure 5:
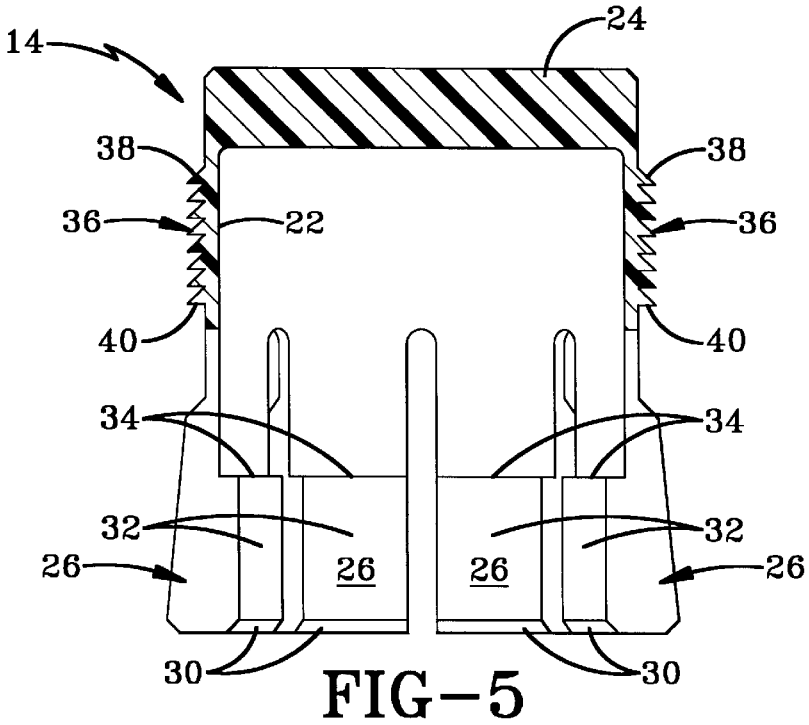
FIG. 5 is a sectional view taken along line 5—5 of FIG. 2.

A bottle security device according to the concepts of the present invention is depicted in the accompanying drawings and is indicated generally by the numeral 10. Bottle security device 10 generally includes an outer sleeve member 12 and an inner member 14 that cooperate to lock device 10 on the neck 16 of a typical bottle 18. Bottle security device 10 remains locked on bottle neck 16 until a user unlocks device 10 with a key 20.

Figure 6:
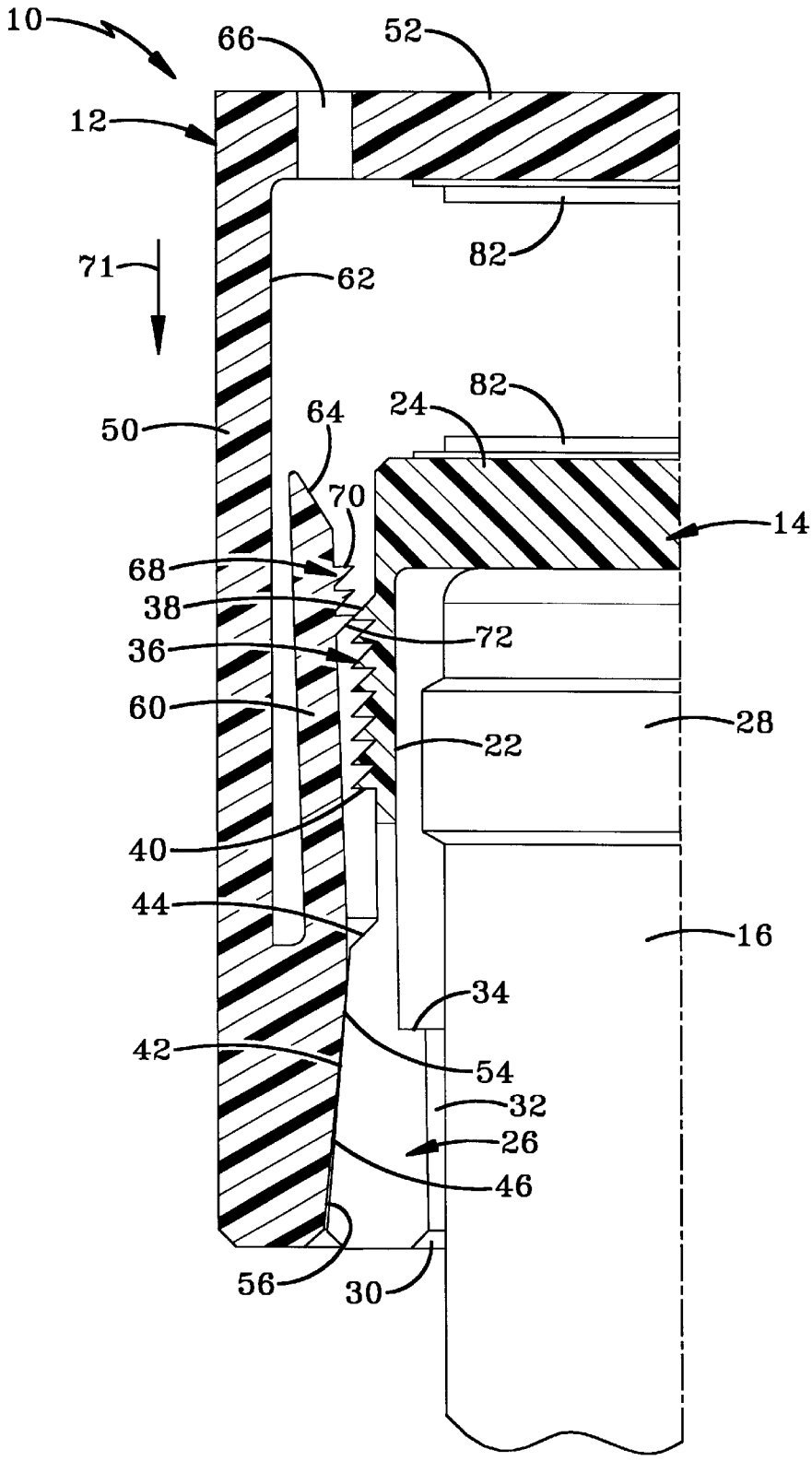
FIG. 6 is a sectional view of the bottle security device of the present invention in a first unlocked position with the outer sleeve member moving down over the inner member.

Inner member 14 includes a substantially cylindrical body 22 closed at one end by a substantially circular end wall 24. A plurality of fingers 26 extend away from body 22 in a direction away from end wall 24. Fingers 26 are configured to fit over the bead 28 typically disposed on neck 16 of bottle 18. Fingers 26 may be sized to engage bead 28 and be forced radially outwardly when inner member 14 is forced over bead 28. To facilitate such movement, each finger 26 is provided with an angled surface 30 configured to engage the upper surface of bead 28 when inner member 14 is forced over bead 28. Fingers 26 are further configured to be resilient such that they return to their resting position after being forced over bead 28. In such a resting position, as depicted in FIG. 6, the inner surfaces 32 of arms 26 may or may not contact neck 16 depending on the size of bottle 18. A shoulder 34 formed in each finger 26 is disposed below bead 28 once inner member 14 is placed on bottle 18 such that the top of neck 16 engages the inner surface of end wall 24.

The annular outer surface of body 22 of inner member 14 includes a plurality of annular teeth 36 that project radially outwardly from body 22. Each tooth 36 includes an upwardly facing angled portion 38 and a locking portion 40 that is disposed substantially normal to the outer surface of body 22 of inner member 14. Teeth 36 are disposed over a substantial longitudinal portion of body 22. Teeth 36 may also be disposed about the outer side surface of end wall 24. Further, teeth 36 may also extend down onto fingers 26 as needed.

Each locking finger 26 also includes an outwardly tapered outer wall 42. An upper ledge 44 connects each outer wall 42 to body 22. Tapered wall 42 is configured to cooperate with a camming surface 46 on outer sleeve member 12 to urge fingers 26 inwardly against neck 16 when security device 10 is in the locked position.

Outer sleeve member 12 is generally configured to fit over inner member 14 and substantially enclose inner member 14 such that inner member 14 may not be readily viewed or accessed from outside bottle security device 10. Outer sleeve member 12 includes a substantially cylindrical sidewall 50 bounded at its upper end by an end wall 52. The lower end of sidewall 50 is configured into camming surface 46 which is tapered such that the upper end 54 of camming surface 46 has a smaller diameter than the lower end 56 of camming surface 46. A plurality of upwardly cantilevered locking arms 60 project from upper end 54 of camming surface 46 into the interior of outer sleeve member 12.

Cantilevered arms 60 are spaced from the inner surface 62 of sidewall 50 such that arms 60 may be urged radially outwardly. Each cantilevered arm 60 has an angled upper end 64 that is disposed directly in line with an opening 66 in end wall 52. Each cantilevered arm 60 further includes a plurality of inwardly projecting teeth 68 that are configured to cooperate with teeth 36 to provide a locking go connection between inner member 14 and outer sleeve member 12. As such, each tooth 68 is also annularly disposed about arms 60 and each includes an angled portion 72 and a locking portion 70 that is substantially normal to the inner surface of arms 60. Locking portion 70 is configured to be substantially the same size as locking portion 40 of teeth 36 of inner member 14. Angled portions 72 and 38 are configured to allow teeth 68 and 36 to slide over each other when outer sleeve member 12 is moved downwardly over inner member 14 but to lockingly engage when outer sleeve member 12 is moved upwardly.

Outer sleeve member 12 and inner member 14 may be preferably fabricated from a plastic that is resistant to the typical destructive forces that a prospective shoplifter may inflict on device 10. Members 12 and 14 may, however, be fabricated from other suitable materials in other embodiments of the present invention. In such other embodiments, different numbers of fingers 26 and cantilevered arms 60 may be used to accomplish the concepts of the present invention. In still other embodiments of the present invention, the overall shapes of outer sleeve member 12 and inner member 14 may be varied without departing from the concepts of the present invention.

The use of bottle security device 10 with bottle 18 is depicted in cross section in FIGS. 6–10. A first position for bottle security device 10 is depicted in cross section in FIG. 6 with outer sleeve member 12 initially engaging inner member 14. In this position, inner member 14 has already been placed on neck 16 of bottle 18 such that fingers 26 have been urged over bead 28. Once inner member 14 is placed on neck 16, outer sleeve member 12 is fit over inner member 14 and moved downwardly as indicated by the directional arrow labeled with numeral 71. In the position depicted in FIG. 6, camming surface 46 has just initially engaged outer surface 42 of fingers 26.

Figure 7:
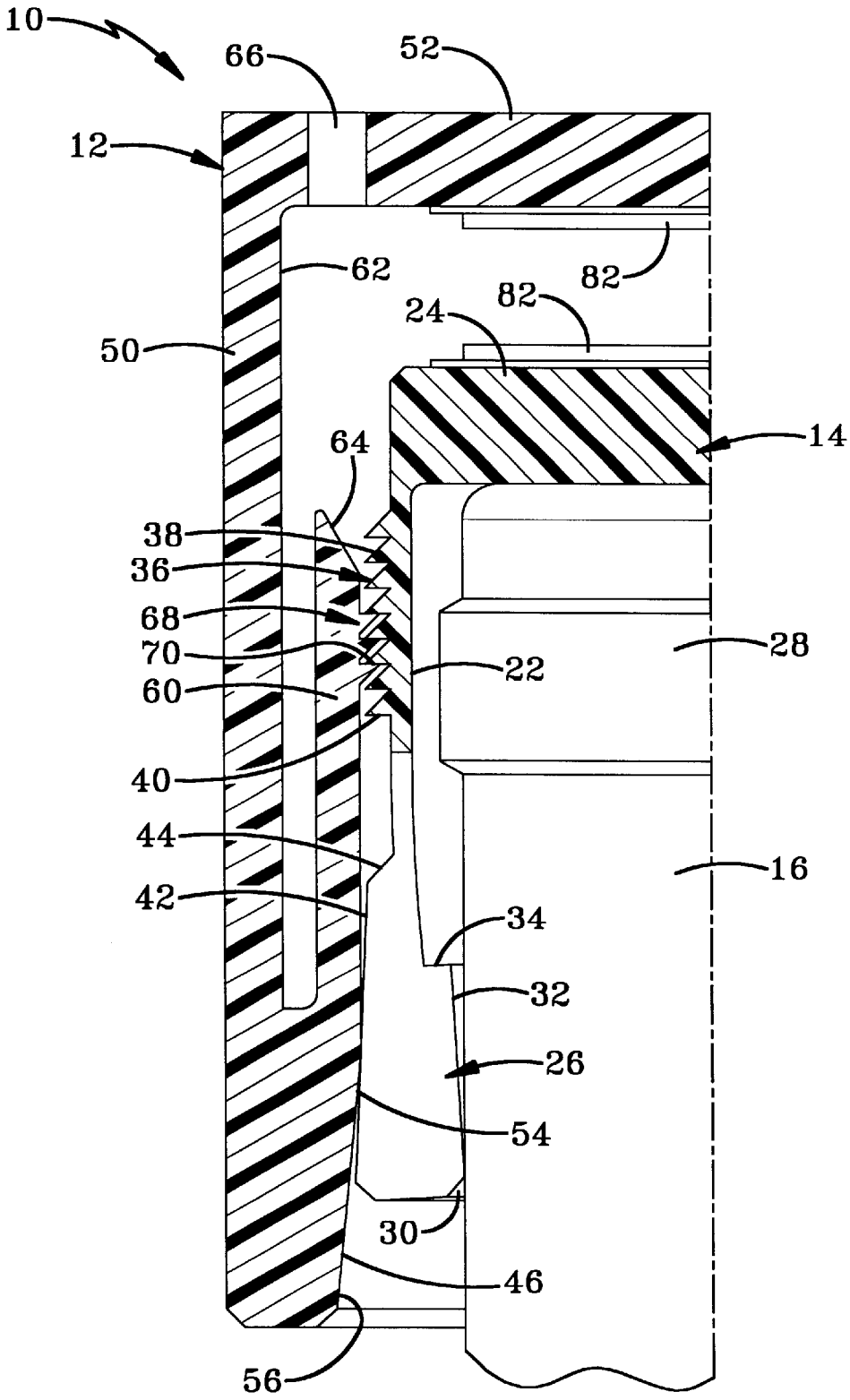
FIG. 7 is a sectional view of the bottle security device in a locked position.
Figure 8:
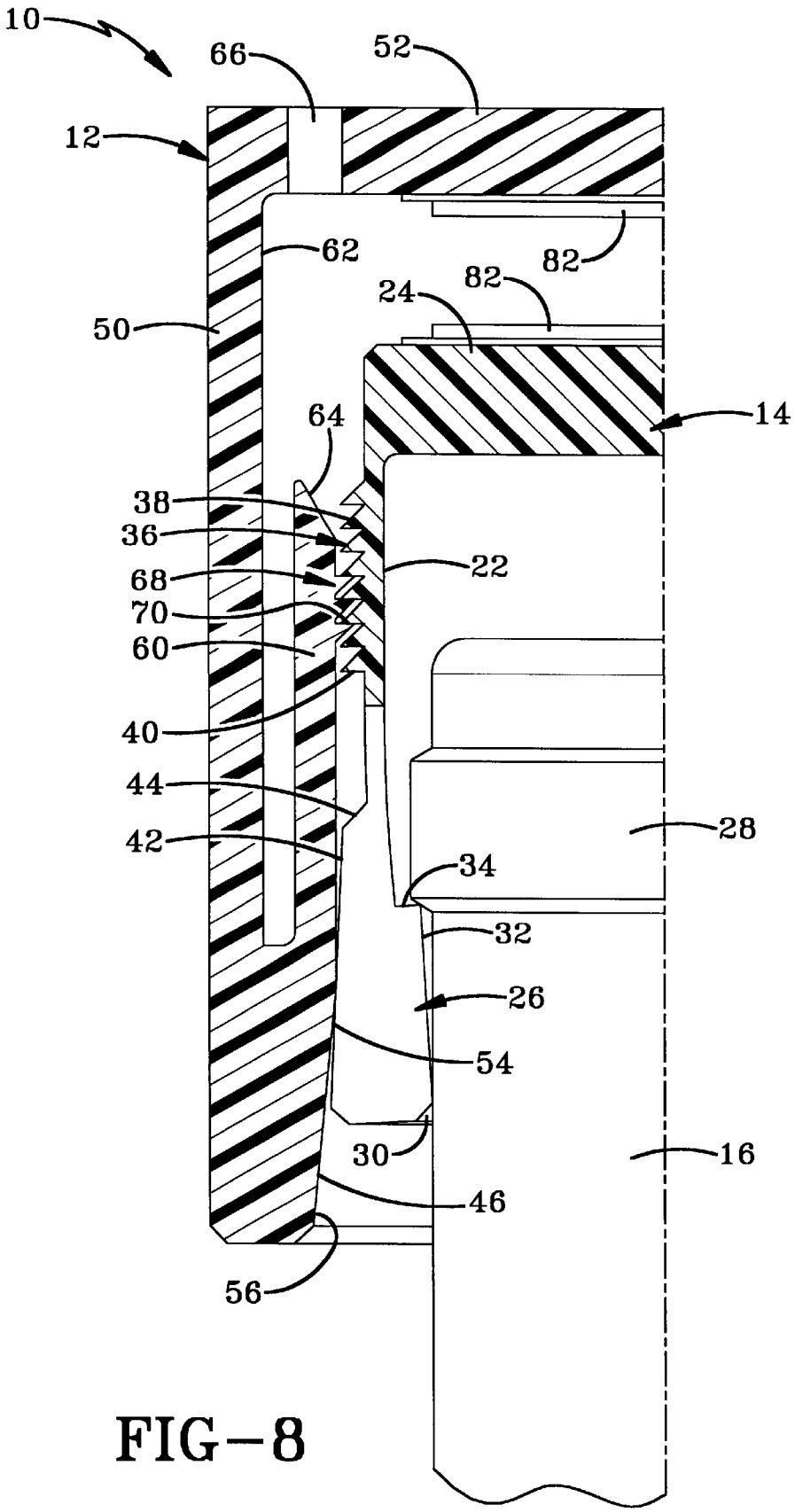
FIG. 8 is a sectional view of the bottle security device in a locked position while someone is attempting to remove the bottle from the bottle security device.

FIG. 7 depicts the next position of bottle security-device 10 with outer sleeve member 12 having been moved down farther along inner member 14 such that camming surface 46 has urged fingers 26 inwardly against neck 16 of bottle 18. The continued movement of outer sleeve member 12 has also caused teeth 68 and 36 to engage in an interfering engagement. In this position, bottle security device 10 is locked on neck 16 of bottle 18 such that it cannot be removed by a shoplifter. An attempt to remove bottle security device 10 from bottle 18 is depicted in FIG. 8. When such an attempt is made, shoulders 34 of inner member 14 engage bead 28 of bottle 18 preventing the further upward movement of bottle security device 10 with respect to bottle 18.

As depicted in FIG. 8, shoulder 34 engages lower edge of bead 28 while teeth 36 and 78 prevent outer sleeve member 12 from moving upwardly with respect to inner member 14. In both the positions depicted in FIGS. 7 and 8, the contents of bottle 18 cannot be removed from bottle 18 without breaking bottle 18. The configuration of bottle security device 10 also allows outer member 12 to rotate with respect to inner member 14 while in the locked position. Such rotation further frustrates the prospective shoplifter. Locking fingers 26 are also configured to substantially fill the space between outer sleeve member 12 and bottle neck 16 such that a prospective shoplifter cannot easily insert a pry bar between outer sleeve member 12 and inner member 14 to potentially break bottle security device 10 away from bottle 18. Outer sleeve member 12 is also fabricated from a material that substantially resists such prying forces.

Figure 9:
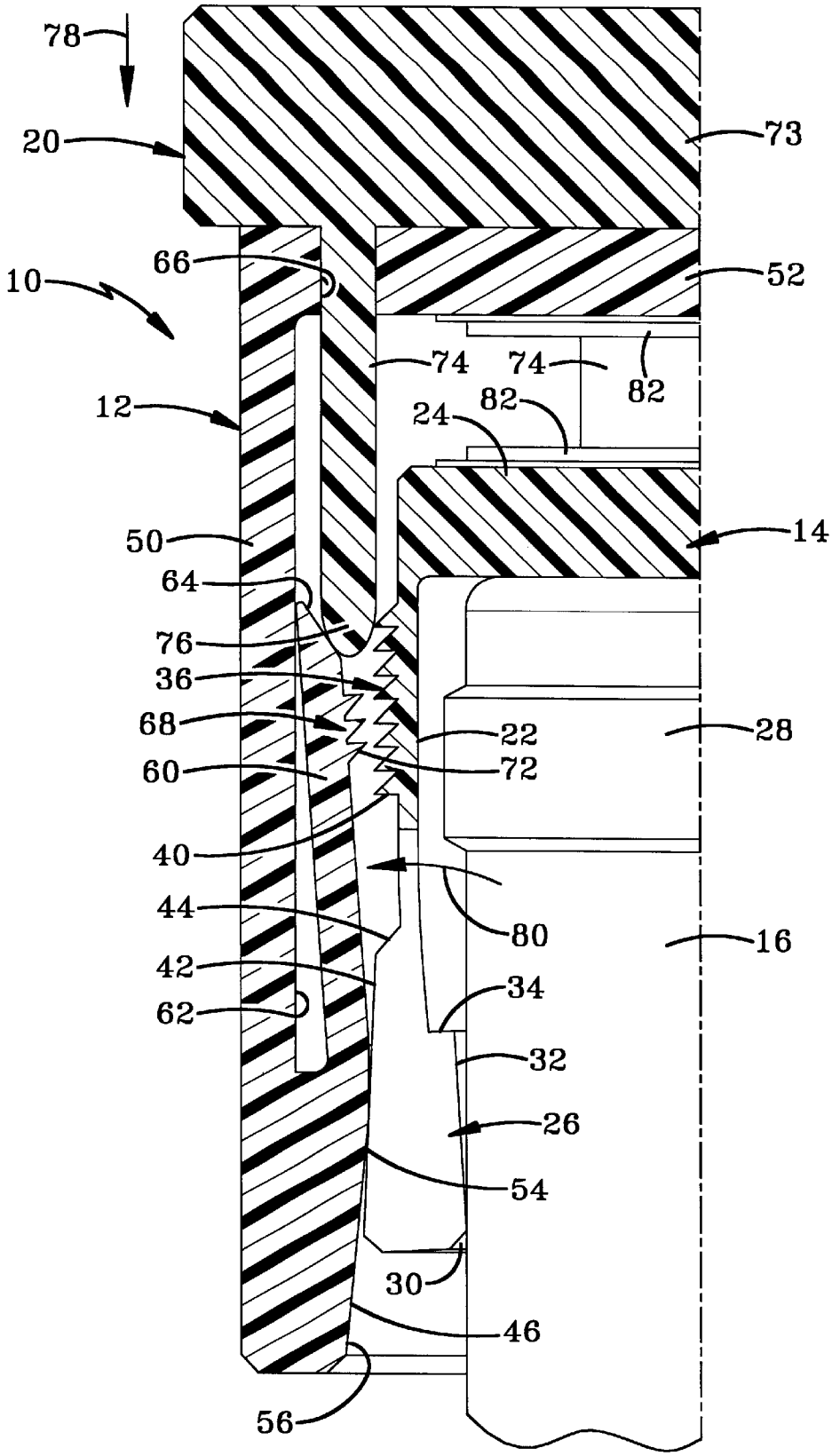
FIG. 9 is a sectional view of the bottle security device of the present invention being used with a corresponding key to disengage the outer sleeve member from the inner member.
Figure 10:
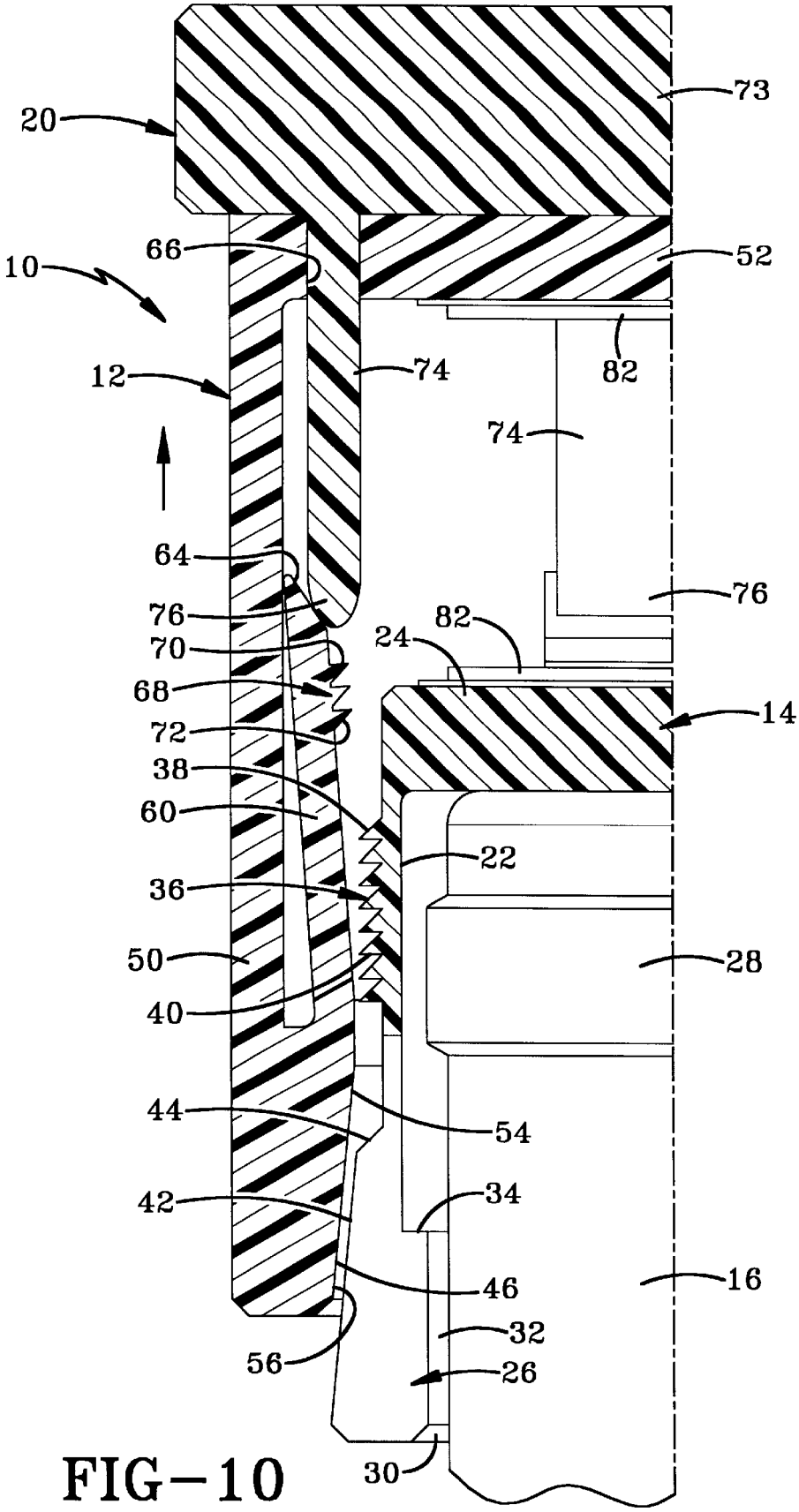
FIG. 10 is a sectional view of the bottle security device of the present invention being used with a corresponding key with the outer sleeve member being removed from the inner member.

Bottle security device 10 is removed from bottle 18 by utilizing key 20 as depicted in FIGS. 9 and 10. Key 20 includes a base 73 from which extends an elongated cam 74 for each of cantilevered arms 60. In the embodiment of the invention depicted in the drawings, four elongated cams 74 project from base 73 to correspond with the four cantilevered arms 60 of outer sleeve member 12. Each elongated cam 74 has a rounded end 76 configured to cooperate with angled surface 64 of cantilevered arms 60. Such cooperation is depicted in FIG. 9 where key 20 has been inserted through openings 66 and end wall 52 of outer sleeve member 12. Full insertion of key 20 causes elongated cams 74 to engage cantilevered arms 60 and force them radially outwardly a distance sufficient to disengage teeth 68 from teeth 36. The movement of key 20 is indicated by the arrow labeled with numeral 78 while the movement of cantilevered arms 60 is indicated by the arrow labeled with numeral 80. Once key 20 is fully inserted and cantilevered arms 60 are urged radially outwardly, outer sleeve member 12 and key 20 may be moved upwardly with respect to inner member 14 and removed from bottle 18 as indicated by the arrow labeled with numeral 81. Once outer sleeve member 12 and key 20 are removed, the user may remove inner member 14 from neck 16 of bottle 18. Locking device 10 may then be reused on another suitable bottle 18.

An EAS tag 82 may be disposed in various locations on bottle security device 10 such that EAS tag 82 may not be removed from bottle security device 10 and thus bottle 18 when bottle security device 10 is in the locked position on bottle 18. For example, EAS tag 82 may be disposed on the inwardly facing surface of end wall 52 of outer sleeve member 12 as depicted in FIG. 10. EAS tag 82 may also be disposed on the upwardly facing surface of end wall 24 of inner member 14. An alternative location for EAS tag 82 is the inwardly facing surface of end wall 24 of inner member 14. In other embodiments of the present invention, EAS tag 82 may be positioned about the inner wall 62 of sidewall 50 of outer sleeve member 12. In each of these locations, EAS tag 82 may not be removed by the prospective shoplifter when bottle security device 10 is locked on bottle 18.

Figure 11:
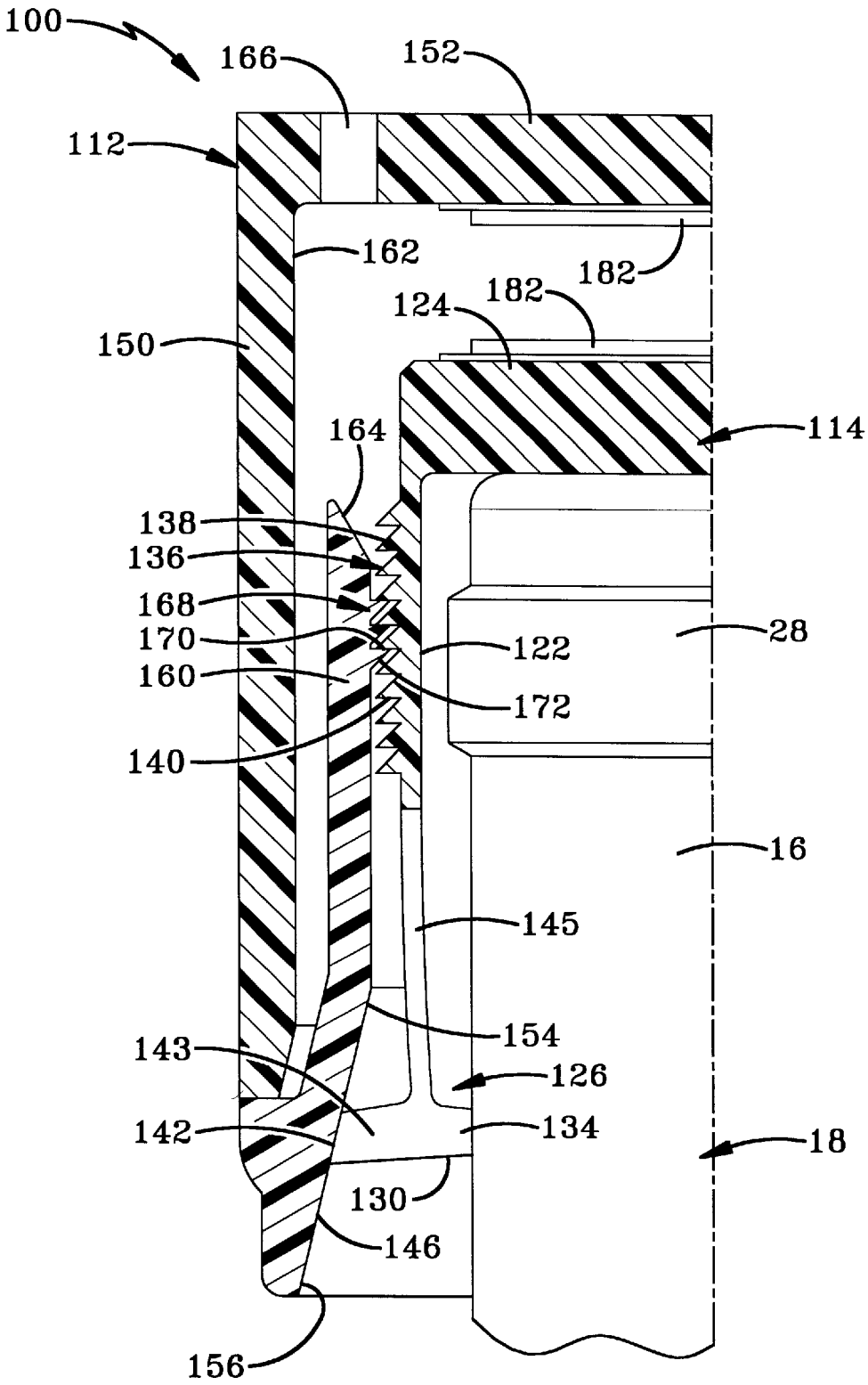
FIG. 11 is a sectional view similar to FIG. 7 depicting an alternative embodiment of the present invention in a locked position on the neck of a bottle.

An alternative embodiment of a bottle security device according to the concepts of the present is depicted in FIG. 11 and is indicated generally by the numeral 100. Bottle security device 100 generally includes an outer sleeve member 112 and an inner member 114 that cooperate to lock device 100 on the neck of a typical bottle 18. Bottle security device 100 remains locked on bottle neck 16 until a user unlocks device 100 with an appropriate key.

Inner member 114 includes a substantially cylindrical body 122 closed at one end by a substantially circular end wall 124. A plurality of fingers 126 are configured to fit over bead 28 typically disposed on neck 16 of bottle 18. Fingers 126 may be sized to engage bead 28 and be forced radially outwardly when inner member 114 is forced over bead 28. To facilitate such movement each finger 126 is provided with a slightly angled lower surface 130 configured to engage the upper surface of bead 28 when inner member 114 is forced over bead 28. Fingers 126 are further configured to be resilient such that they return to their resting position after being forced over bead 28. A shoulder 134 formed in each finger 126 is disposed below bead 28 once inner member 114 is placed on bottle 18 such that the top of neck 16 engages the inner surface of end wall 124.

The annular outer surface of body 122 of inner member 114 includes a plurality of annular teeth 136 that project radially outwardly from body 122. Each tooth 136 includes an upwardly facing angled portion 138 and a locking portion 140 that is disposed substantially normal to the outer surface of body 122 of inner member 114. Teeth 136 are disposed over a substantial longitudinal portion of body 122. Teeth 136 may also be disposed about the outer side surface of end wall 124. Further, teeth 136 may also extend down onto fingers 126 as needed.

Each locking finger 126 also includes an outwardly tapered outer wall 142 that is disposed on the outwardly facing surface of a shoulder 143. Shoulder 143 and shoulder 134 are disposed at the end of a neck portion 145 of locking finger 126. Tapered wall 142 is configured to cooperate with a camming surface 146 on outer sleeve member 112 to urge fingers 126 inwardly against neck 16 when security device 100 is in the locked position.

Outer sleeve member 112 is generally configured to fit over inner member 114 and substantially enclose inner member 114 such that inner member 114 may not be readily viewed or accessed from outside bottle security device 100. Outer sleeve member 112 includes a substantially cylindrical sidewall 150 bounded at its upper end by an end wall 152. The lower end of sidewall 150 is configured into camming surface 146 which is tapered such that the upper end 154 of camming surface 146 has a smaller diameter than the lower end 156 of camming surface 146. A plurality of upwardly cantilevered locking arms 160 project from upper end 154 of camming surface 146 into the interior of outer sleeve member 112.

Cantilevered arms 160 are spaced from inner surface 162 of sidewall 150 such that arms 160 may be urged radially outwardly. Each cantilevered arm 160 has an angled upper end 164 that is disposed directly in line with an opening 166 and end wall 152. Each cantilevered arm 160 further includes a plurality of inwardly projecting teeth 168 that are configured to cooperate with teeth 136 to provide a locking connection between inner member 114 and outer sleeve member 112. As such, each tooth 168 is also annularly disposed about arms 60 and each includes an angled portion 172 and a locking portion 170 that is substantially normal to the inner surface of arms 160. Locking portion 170 is configured to be substantially the same size as locking portion 140 of teeth 136 of inner member 114. Angled portions 172 and 138 are configured to allow teeth 168 and 136 to slide over each other when outer sleeve member 112 is moved downwardly over inner member 114 but to lockingly engage when outer sleeve member 112 is moved upwardly.

Security device 100 may be configured to fit bottles 18 having different neck 16 sizes by adjusting the size of shoulders 134 and 156. For instance, when device 100 is to be used with a bottle having a thin neck 16, the radial length of shoulder 134 is increased. When device 100 is used with a bottle having a thick neck 16, the radial dimension of shoulder 134 is reduced. Similarly, the radial dimension of shoulder 156 may be adjusted.

An EAS tag 182 may be disposed in an appropriate location as depicted in FIG. 11. Furthermore, security device 100 may be more easily fabricated by separating outer member 112 into two pieces as depicted in FIG. 11 with the two pieces being snap fit or otherwise permanently attached after manufacture.

Figure 13:
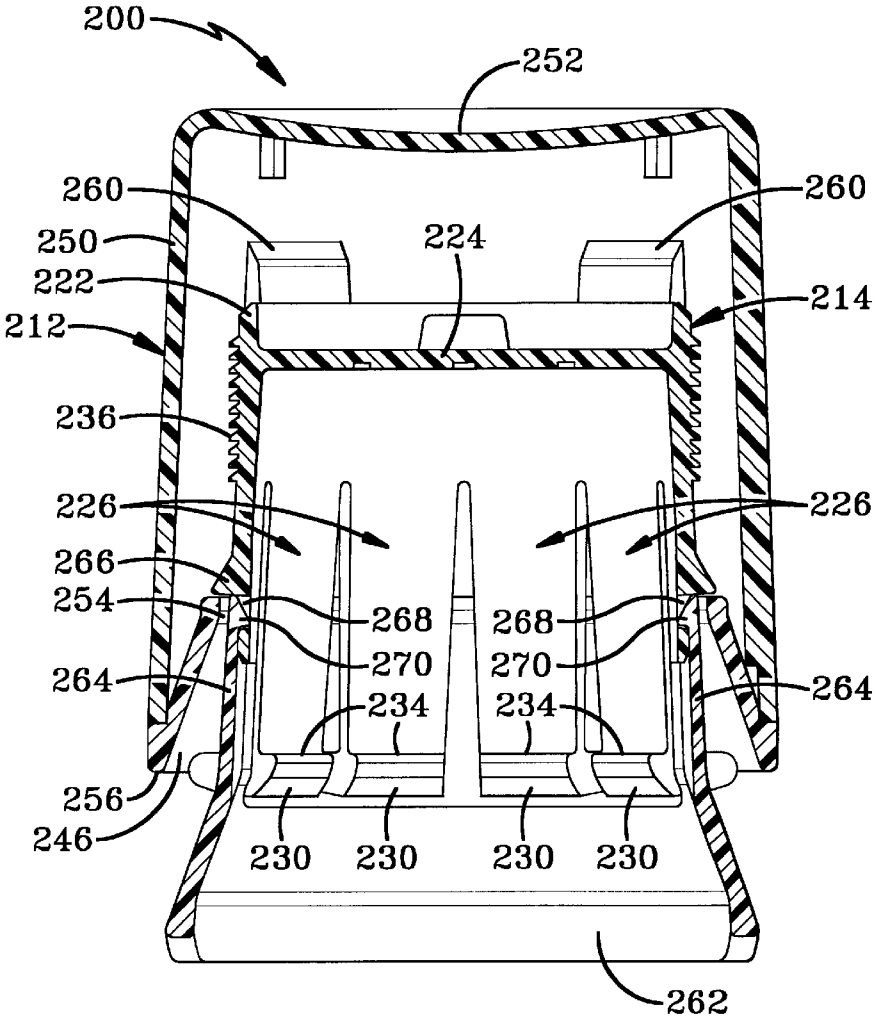
FIG. 13 is a sectional view taken along line 13—13 of FIG. 12.
Figure 12:
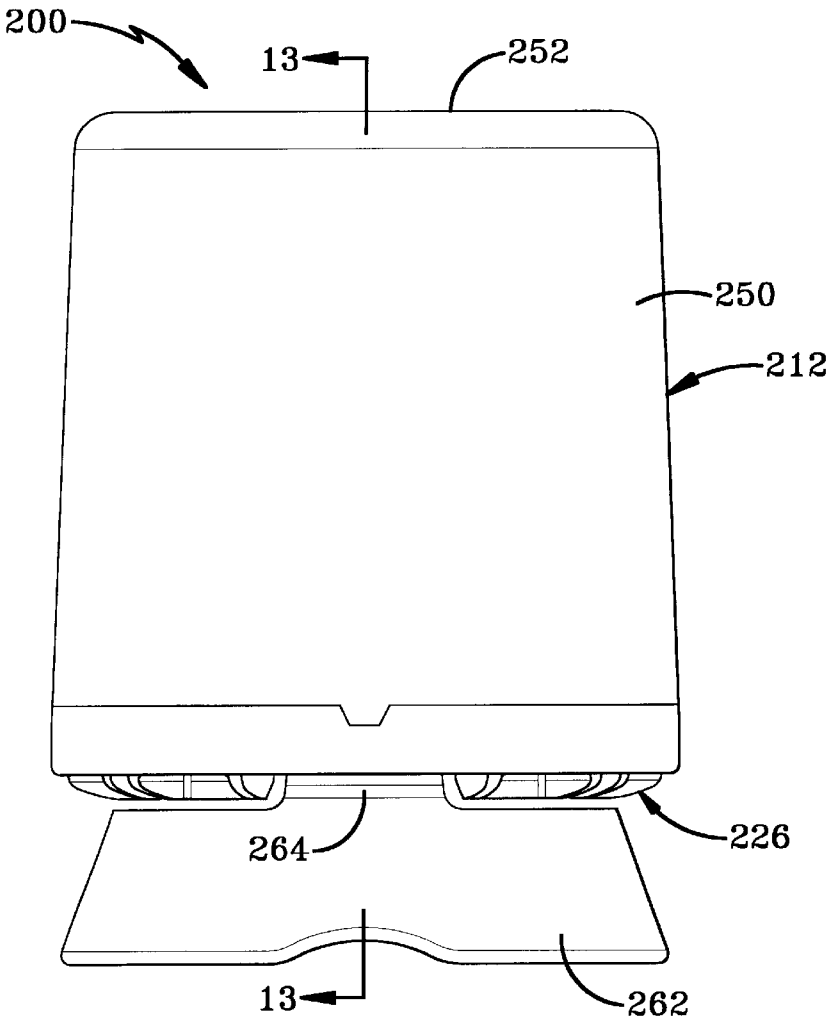
FIG. 12 is a front elevational view of a second alternative embodiment of the present invention.

A second alternative embodiment of the bottle security device of the present invention is indicated generally by the numeral 200 in FIGS. 12 and 13. Bottle security device 200 generally includes an outer sleeve member 212 and an inner member 214 that cooperate to lock device 200 on the neck of a typical bottle 18. Bottle security device 200 remains locked on bottle neck 16 until a user unlocks device 200 with an appropriate key.

Inner member 214 includes a substantially cylindrical body 222 closed at one end by a substantially circular end wall 224. A plurality of fingers 226 are configured to fit over bead 28 typically disposed on neck 16 of bottle 18. Fingers 226 may be sized to engage bead 28 and be forced radially outwardly when inner member 214 is forced over bead 28. To facilitate such movement, each finger 226 is provided with an angled lower surface 230 configured to engage the upper surface of bead 28 when inner member 214 is forced over bead 28. Fingers 226 are further configured to be resilient such that they return to their resting position after being forced over bead 28. A shoulder 234 formed in each finger 226 is disposed below bead 28 once inner member 214 is placed on bottle 18 such that the top of neck 16 engages the inner surface of end wall 224.

The annular outer surface of body 222 of inner member 214 includes a plurality of annular teeth 236 that project radially outwardly from body 222. Teeth 236 are substantially similar to teeth 36 and teeth 136 as described above with respect to the other embodiments of the present invention.

Each locking finger 226 also includes an outwardly tapered outer wall that is substantially similar to outer wall 142 described above and includes a shoulder substantially similar to shoulder 143 described above. These surfaces allow fingers 226 to interact with a camming surface 246 disposed on outer sleeve member 212 to urge fingers 226 inwardly against neck 16 when security device 200 is in the locked position.

Outer sleeve member 212 is generally configured to fit over inner member 214 and substantially enclose inner member 214 such that inner member 214 may not be readily viewed or accessed from outside bottle security device 200. Outer sleeve member 212 includes a substantially cylindrical side wall 250 bounded at its upper end by an end wall 252. The lower end of side wall 250 is configured into camming surface 246 which is tapered such that the upper end 254 of camming surface 246 has a smaller diameter than the lower end 256 of camming surface 246. The plurality of upwardly cantilevered locking arms 260 project from upper end 254 of camming surface 246 into the interior of outer sleeve member 212. Cantilevered arms 260 operate the same as cantilevered arms 160 and 60 described above with respect to the other embodiments of the present invention.

Bottle security device 200 further includes a protective ring 262 that is carried by inner member 214. Protective ring 262 extends around neck 16 and a portion of bottle 18 and prevents shoplifters from easily inserting a pry-bar into bottle security device 200. Ring 262 is generally frustoconical in shape and includes a lower end that is generally thicker than the upper end. The shape and this thickness prevent a thief from accessing fingers 226 with a pry bar.

Protective ring 262 is connected to inner member 214 by a pair of upwardly extending connectors 264 that are oppositely disposed on protective ring 262. Connectors 264 are snap fit into a pair of receiving members 266 having a hole 268 that receives a bar 270 disposed on connectors 264. Bar 270 snap fits into hole 268 and forms a substantially permanent connection between protective ring 262 and inner member 214. Protective ring 262 also allows the user of device 200 to manipulate inner member 214 once outer member 212 is placed over inner member 214. This is important on some bottles where it is desired to push inner member 214 up further into outer member 212 so that more teeth 236 engage.

Accordingly, the present invention of the bottle security device 10 is simplified, provides an effective, safe, inexpensive, and efficient device which achieves all of the enumerated objectives of the invention, provides for eliminating difficulties encountered with prior devices, and solves problems and obtains new results in the art.

In the foregoing description, certain terms have been used for brevity, clearness and understanding, but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact detail shown or described.

Having now described the features, discoveries and principles of the invention, the manner in which the bottle security device is constructed and used, the characteristics of the construction, and the advantageous, new and useful results obtained; the new and useful structures, devices, elements, arrangements, parts and combinations, are set forth in the appended claims.

What is claimed is:

1. A bottle security device for use with a bottle having a neck, the bottle security device comprising:

an inner member adapted to fit around at least a portion of the neck of the bottle;

at least one tooth projecting outwardly from the inner member;

an outer member having a cavity, the inner member selectively positionable in the cavity;

at least one arm resiliently cantilevered from the outer member and disposed in the cavity;

at least one tooth projecting inwardly from the arm; and the tooth on the inner member engaging the tooth on the arm when the inner member is positioned in the cavity to prevent the inner member from being removed from the cavity.

2. The device of claim 1, wherein the inner member includes a body and a plurality of resilient fingers cantilevered from the body.

3. The device of claim 2, wherein the inner member further includes an end wall; the body having first and second opposed ends; the end wall connected to the first end and the fingers connected to the second end of the body.

4. The device of claim 3, wherein the end wall is substantially circular.

5. The device of claim 2, wherein each finger has a first end and a second end; the first end being connected to the body; and the second end having an inwardly-facing shoulder.

6. The device of claim 5, wherein the second end of each finger has an inwardly angled surface.

7. The device of claim 1, wherein the inner member includes a plurality of teeth.

8. The device of claim 7, wherein each tooth is annular.

9. The device of claim 1, wherein the inner member has an outer surface with an upper end and a lower end; the tooth of the inner member including an upwardly facing angled portion and a locking portion; the locking portion being substantially normal to the outer surface of the inner member.

10. The device of claim 9, wherein the tooth projecting from the arm includes a downwardly facing angled portion and a locking portion.

11. The device of claim 1, wherein the outer member includes four arms.

12. The device of claim 1, wherein the outer member has an opening aligned with the arm.

13. The device of claim 12, in combination with a key; the key having a cam sized to selectively slide through the opening in the outer member and engage the arm of the outer member to move it away from the inner member.

14. The device of claim 1, further comprising a ring attached to the inner member; the ring adapted to surround a portion of the neck.

15. The device of claim 1, further comprising an electronic article surveillance device mounted on one of the inner and outer members.

16. The device of claim 1, wherein the outer member has an upper end and a lower end; a camming surface disposed about the lower end of the outer member; the inner member having an upper end a lower end, the lower end being tapered; the tapered lower end of the inner member engaging the camming surface of the outer member to force the lower end of the inner member in an inward direction.

17. The device of claim 1, wherein the outer member has an upper end and a lower end; the at least one arm being resiliently cantilevered to the outer member adjacent the lower end of the outer member.

18. The device of claim 17, wherein the at least one arm includes an upper end disposed closer to the upper end of the outer member than the lower end of the outer member.

19. The device of claim 18, wherein the upper end of the at least one arm is angled.

20. A bottle security device for use with a bottle having a neck, the bottle security device comprising:

an inner member adapted to fit around at least a portion of the neck of the bottle; the inner member including a plurality of fingers and a pair of opposed receiving members;

an outer member having a cavity, the inner member selectively lockable in the cavity; and a ring connected to the inner member; the ring adapted to surround a portion of the neck of the bottle; the ring being connected to the receiving members and disposed below the fingers.

21. The device of claim 20, wherein the ring is a frustum, the outer member abutting the ring to block access to the inner member.

22. A bottle security device for use with a bottle having a neck, the bottle security device comprising:

an inner member adapted to fit around at least a portion of the neck of the bottle;

the inner member having a body portion;

a plurality of annular teeth extending outwardly from the body portion of the inner member;

an outer member having a cavity, the inner member selectively positionable in the cavity;

the outer member having an upper end and a lower end;

at least three arms resiliently cantilevered from the lower end of the outer member;

each of the arms extending in the cavity toward the upper end of the outer member;

at least one tooth projecting inwardly from each of the arms;

at least one of the teeth on the inner member engaging the tooth on each arm when the inner member is positioned in the cavity to prevent the inner member from being removed from the cavity;

the upper end of the outer member having an opening aligned with each of the arms; and a key having a cam for each of the arms; each cam being selectively slidable through an opening to engage an arm to move the arm away from the inner member to disengage the arm from the inner member.

23. A bottle security device for use with a bottle having a neck, the bottle security device comprising:

an inner member adapted to slide over at least a portion of the neck of the bottle;

the inner member including a plurality of fingers;

an outer member defining a cavity, the inner member being selectively lockable in the cavity;

a ring connected to the inner member; the ring adapted to surround a portion of the neck of the bottle;

the ring protecting the fingers when the inner member is disposed on the bottle; and the inner member including opposed receiving members; the ring being connected to the receiving members and disposed below the fingers.

24. A bottle security device for use with a bottle having a neck, the bottle security device comprising:

an inner member adapted to slide over at least a portion of the neck of the bottle;

at least one locking tooth connected to the inner member;

an outer member defining a cavity, the inner member being selectively lockable in the cavity;

at least one locking tooth connected to the outer member;

the locking teeth engaging each other to lock the inner member within the outer member;

a ring connected to the inner member; the ring adapted to surround a portion of the neck of the bottle; and the outer member including a cantilevered arm projecting into the cavity; the locking tooth of the outer member being disposed on the arm.

25. A bottle security device for use with a bottle having a neck, the bottle security device comprising:

an inner member adapted to fit around at least a portion of the neck of the bottle;

an outer member having a cavity, the inner member being selectively positionable in the cavity;

at least one arm resiliently cantilevered from the outer member and disposed in the cavity; the arm being selectively movable from a locked position to an unlocked position; and the at least one arm lockingly engaging the inner member when the at least one arm is disposed in the locked position and releasing the inner member when the at least one arm is in an unlocked position.

26. The device of claim 25, wherein the outer member defines a key opening that is aligned with the at least one arm.

27. The device of claim 25, wherein the outer member has an upper end and a lower end; a camming surface disposed adjacent the lower end of the outer member; the inner member having an upper end and a lower end, the lower end being tapered; the tapered lower end of the inner member engaging the camming surface of the outer member to force the lower end of the inner member in an inward direction when the inner member is inserted into the cavity of the outer member.

* * * * *